US005086826A

United States Patent [19]

Frauenkron et al.

[11] Patent Number: 5,086,826

[45] Date of Patent: Feb. 11, 1992

[54] APPARATUS FOR THE AFTER-COOLING AND COILING OF CAST METAL STRIPS

[75] Inventors: Armin Frauenkron, Dortmund; Herbert Gellenbeck, Hemer, both of Fed. Rep. of Germany

[73] Assignee: Sundwiger Eisenhutte Maschinenfabrik GmbH & Co., Hemer-Sundwig, Fed. Rep. of Germany

[21] Appl. No.: 698,716

[22] Filed: May 10, 1991

[30] Foreign Application Priority Data

May 14, 1990 [DE] Fed. Rep. of Germany ..... 4015438

[51] Int. Cl.[5] ..... B22D 11/24; B22D 11/28

[52] U.S. Cl. ..... 164/417; 164/441; 164/443; 164/447; 164/477

[58] Field of Search ..... 164/269, 417, 441, 443, 164/423, 429, 447, 463, 477, 479, 484, 485

[56] References Cited

U.S. PATENT DOCUMENTS 4,316,497 2/1982 Wakefield et al. ..... 164/479
4,644,999 2/1987 Bedell et al. ..... 164/479 X
4,977,949 12/1990 Shibuya et al. ..... 164/417

*Primary Examiner*—J. Reed Batten, Jr.
*Attorney, Agent, or Firm*—Marmorek, Guttman & Rubenstein

[57] ABSTRACT

The cast metal strip is retained on both sides between supporting and conveying elements, the supporting and conveying elements comprising on one side a group of wire cables 6, 12, 18, 27 and on the other side either a similar group of wire cables 5, 24 or a cooling roller 11, 17 or a coiler 23. The wire cables 5, 6, 17, 18, 24 and 27 ensure that the cast metal strip 4 is guided with as small a contact area as possible, so that on the one hand the strip is less stressed and on the other hand can irradiate heat.

1 Claim, 1 Drawing Sheet

APPARATUS FOR THE AFTER-COOLING AND COILING OF CAST METAL STRIPS

Figure 1:
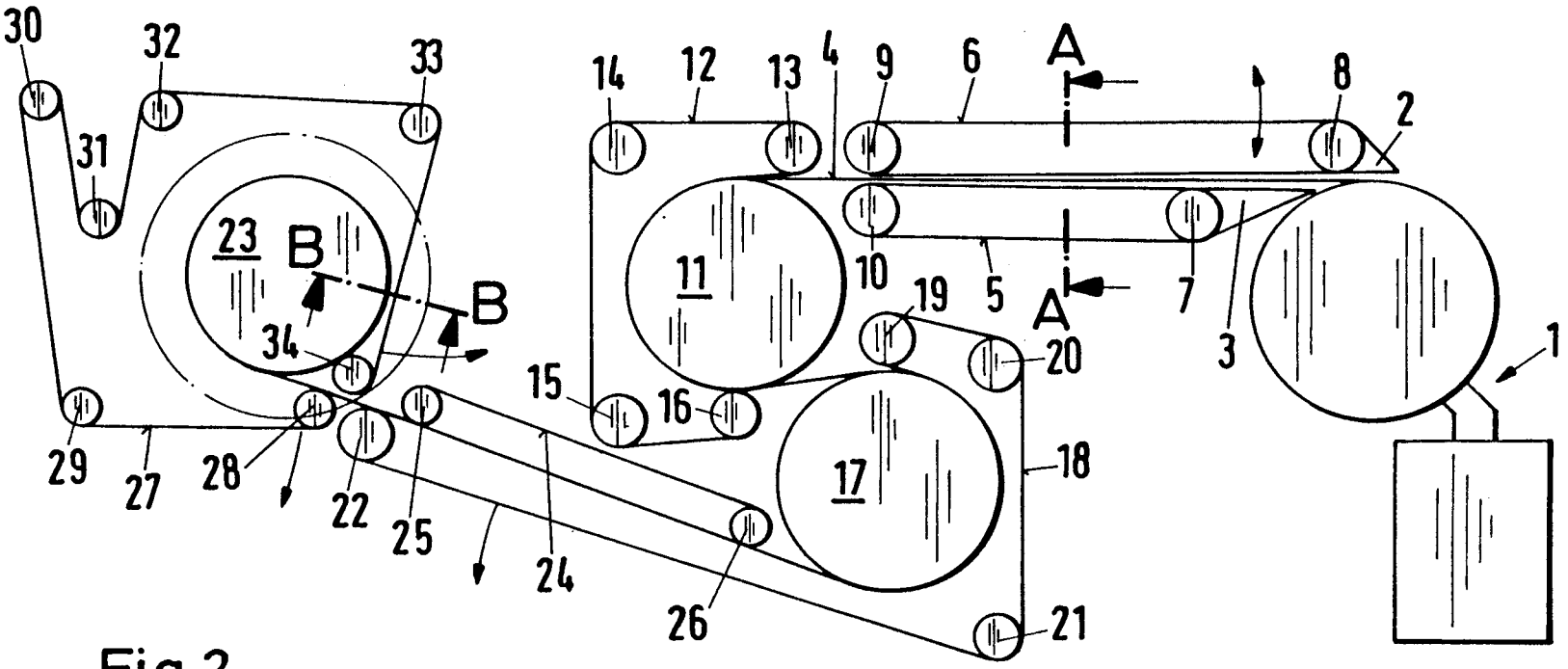

The invention relates to an apparatus for the after-cooling and coiling of metal strips produced by a strip casting machine, comprising at least one cooling roller and one coiler and also guiding and deflecting elements.

It is part of general prior art practice to after-cool before coiling on a coiler the rapidly moving still hot metal strips arriving from a casting machine which are sensitive on the surface and also otherwise not very capable of withstanding loading. For this reason the still sensitive metal strips must be loaded as little as possible while being conveyed between the casting machine and the coiler.

To cool hot rolled sheet metal strips it is known to take the strips through a cooling channel whose walls are cooled by a coolant. Supporting and guiding rollers are provided one after the other on the top and bottom sides at short intervals in the direction in which the strip runs, to enable the strip to be guided in the central position through said channel. Quite apart from the fact that due to the screening effect of the supporting and guiding rollers the cooling effect is not optimum, the apparatus is quite expensive, more particularly if the strip must be guided not only over a straight distance, but also in an arc. In the case of mechanically loadable strips, such as hot rolled sheet metal strips, the screening effect of the guiding and supporting rollers may be of no great importance, since the individual guiding and supporting rollers can be spaced wide apart, but with cast metal strips to be after-cooled their lack of loadability means that such long stretches without guiding can hardly be provided without disadvantageous consequences to the metal strip (German Patent Specification 24 14 445 C2).

It is an object of the invention to provide an apparatus of the kind specified which guides the rapidly moving metal strips reliably and gently and enables them to be after-cooled over their conveying path to the coiler.

This problem is solved according to the invention in an apparatus of the kind specified by the feature that the guiding and deflecting elements comprise groups of endless wire cables which are disposed one beside the other distributed over the width of the strip and which are driven in the direction in which the strip runs and which, together with similar groups and/or the cooling roller and the coiler guide the strip between themselves.

In the apparatus according to the invention the hot metal strip is guided with the minimum contact, namely linear contact, between the individual cables and the strip surface. With the use of wire cables disposed on both sides of the strip, the strips can be guided in one plane.

The cables are wrapped around the cooling roller and the coiler and guide the strip on the exposed outer side, while it is guided on the other side by the cooling roller and the coiler. In this way satisfactory surface contact is obtained over the whole wrapping zone of the cooling roller, so that the cooling effect is optimum.

Figure 2:
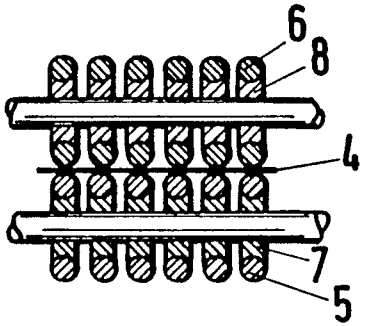
Figure 3:
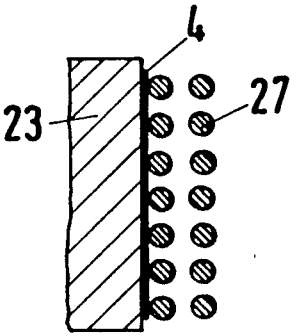

The invention will now be explained in greater detail with reference to the drawings, wherein:

FIG. 1 is a diagrammatic side elevation of an apparatus for the conveying, cooling and coiling of a metal strip arriving from a strip casting machine, FIG. 2 shows the apparatus illustrated in FIG. 1, sectioned along the line A—A, and FIG. 3 shows the apparatus illustrated in FIG. 1, sectioned along the line B—B in FIG. 1.

From a strip casting machine 1 having releasing elements directly connected thereto and if necessary deflecting elements 2, 3 for a cast strip 4, the strip moves into a horizontal plane between two groups of endless wire cables 5, 6 guided over pulleys 7, 8, 9, 10. One group of pulleys 7, 8 is driven both by the bottom pulleys 7, 10 and also by the top pulleys 8, 9 respectively. From the two groups of wire cables 5, 6 the strip passes between the generated surface of a first cooling roller 11 and a group of endless wire cables 12 which are wrapped around the generated surface of the cooling roller 11 and guided over pulleys 13 to 16. One group of pulleys 13 is driven. Disposed downstream of the first cooling roller 11 in the conveying direction is a second cooling roller 17 around a portion of which a group of wire cables 18 is wrapped, as in the case of the first cooling roller 11.

The strip 4 is guided between the wire cables 18 and the generated surface of the second cooling roller 17. This group of wire cables 18 also runs over pulleys 19 to 22 of which one group, for example, the pulleys 22, are driven.

The wire cables 18 extend beyond the generated surface of the second cooling roller 17 as far as a coiler 23 and cooperate with further wire cables 24, which run over pulleys 25, 26, to form a flat conveying distance. One group of pulleys 26 is again driven by the pulleys 25, 26. The strip 4 arriving from said conveying distance passes between the generated surface of a coiler 23 and a group of wire cables 27 which are wrapped therearound and which run over pulleys 28 to 34. Of the pulleys 28 to 34 again one group, for example, the pulleys 28, are driven.

The apparatus according to the invention enables the cast, still hot rapidly moving metal strip 4 to be guided and conveyed with slight contact over the freely guided distances and to be kept in close contact with the cooling rollers 11, 17 and the coiler 23. Due to the small contact area (linear contact) with the wire cables 5, 6, 12, 18, 24 and 27 the strip 4 is substantially unloaded mechanically, and a large area is left exposed for the irradiation of heat.

We claim:

1. An apparatus for the after-cooling and coiling of metal strips (4) produced by a strip casting machine, comprising at least one cooling roller (11, 17) and one coiler (23) and also guiding and deflecting elements (5, 6, 12, 18, 24, 27) characterized in that the guiding and deflecting elements comprise groups of wire cables (5, 6, 12, 18, 24, 27) which are disposed one beside the other distributed over the width of the strip and which are driven in the direction in which the strip runs and which, together with similar groups or the cooling roller (11, 17) and the coiler (23) guide the metal strip (4) between themselves.

* * * * *